US005837350A

United States Patent [19]

Jacobs

[11] Patent Number: 5,837,350

[45] Date of Patent: Nov. 17, 1998

[54] WIDE RANGE VERTICAL RETROREFLECTIVE DELINEATOR

[75] Inventor: Gregory F. Jacobs, Woodbury, Minn.

[73] Assignee: Minnesota Mining and Manufacturing Company, St. Paul, Minn.

[21] Appl. No.: 672,129

[22] Filed: Jun. 27, 1996

Related U.S. Application Data

[60] Provisional application No. 60/000,707 Jun. 29, 1995.

[51] Int. Cl. [6] ..... B32B 3/00; E01F 9/00

[52] U.S. Cl. ..... 428/195; 428/172; 428/913; 404/6; 404/9; 404/14; 116/63 R

[58] Field of Search ..... 428/167, 172, 428/31, 141, 143, 195, 207, 913, 542.2; 404/10, 6, 9, 14; 116/63 R

[56] References Cited

U.S. PATENT DOCUMENTS

| | | | |
|---|---|---|---|
| 3,253,971 | 5/1966 | Garling | 156/246 |
| 3,418,896 | 12/1968 | Rideout | 94/1.5 |
| 3,964,821 | 6/1976 | Eigenmann | 350/105 |
| 4,025,159 | 5/1977 | McGrath | 350/105 |
| 4,145,112 | 3/1979 | Crone et al. | 350/103 |
| 4,152,046 | 5/1979 | Knapp | 350/103 |
| 4,236,788 | 12/1980 | Wyckoff | 350/97 |
| 4,349,598 | 9/1982 | White | 428/161 |
| 4,505,967 | 3/1985 | Bailey | 428/164 |
| 4,636,108 | 1/1987 | Duckett | 404/10 |
| 4,712,867 | 12/1987 | Malek | 350/103 |
| 5,417,515 | 5/1995 | Hachey et al. | 404/15 |

FOREIGN PATENT DOCUMENTS

| | | |
|---|---|---|
| 0 385 746 | 9/1990 | European Pat. Off. . |
| 1 103 487 | 11/1955 | France . |
| 2 557 896 | 7/1985 | France . |
| 665 665 | 5/1988 | Switzerland . |
| WO 87/06996 | 11/1987 | WIPO . |

OTHER PUBLICATIONS

*Patent Abstracts of Japan*, vol. 6, No. 70, (P–113) [948], 6 May 1982, & JP A 57 011301.

U.S. application No. 08/671,280, filed Jun. 27, 1996.

U.S. application No. 08/671,435, filed Jun. 27, 1996.

U.S. application No. 08/672,143, filed Jun. 27, 1996.

U.S. application No. 08/672,177, filed Jun. 27, 1996

*Primary Examiner*—Donald Loney

*Attorney, Agent, or Firm*—Robert H. Jordan

[57] ABSTRACT

Traffic delineators with vertically disposed retroreflective markings that exhibit high retroreflective brightness at high incidence angles and low incidence angles. The delineators are well suited for use on guard rails, Jersey barriers, bridge abutments, walls, barrels, posts, etc., especially in locations near intersecting traffic lanes.

10 Claims, 1 Drawing Sheet

WIDE RANGE VERTICAL RETROREFLECTIVE DELINEATOR

CROSS REFERENCE TO RELATED APPLICATION

This application claims priority to U.S. Provisional Application No. 60/000,707, filed Jun. 29, 1995.

FIELD OF THE INVENTION

The present invention relates to vertical retroreflective delineators that exhibit high retroreflective brightness at both high incidence angles and low incidence angles. The delineators are well suited for use on guard rails, Jersey barriers, bridge abutments, walls, etc., particularly delineators that are subject to approach from a variety of directions.

BACKGROUND

It is well known to use retroreflective traffic signs and delineators on guard rails and so forth for traffic control and safety purposes. Signs are typically disposed so as to be oriented relatively perpendicularly to the direction of travel and approach of vehicles. Conventional retroreflective materials usually provide higher retroreflective performance at entrance or incidence angles of from 0° up to 30° or 40°.

In the case of vertical delineators such as guard rails and Jersey barriers, retroreflective markers are often positioned as protrusions on the surface of the barrier so that light from vehicles traveling on the adjacent road is incident to the markers at a lower incidence angle.

In some instances retroreflective materials that are optimized for retroreflection at high incidence angles are used. For example, U.S. Pat. No. 4,349,598 (White) discloses retroreflective articles that are taught to exhibit retroreflection at incidence angles of about 30° to 85°. Markings of such material on, e.g., a guard rail, disposed parallel to a first road would provide retroreflection to vehicles traveling on the road. Such markings would not, however, provide desired retroreflection to vehicle approaching relatively perpendicularly to the guard rail, e.g., on a second road that intersects the first road.

A need exists for vertical traffic delineators with markings that provide bright retroreflection at both high incidence angles and at low incidence angles.

SUMMARY OF THE INVENTION

The present invention provides vertical delineators that provide bright retroreflection at both high and low incidence angles, i.e., wide range retroreflective delineators.

In brief summary, a typical article of the invention is a traffic delineator having a vertically disposed marking thereon, wherein the marking is disposed substantially parallel to a first road and is retroreflective at substantially all incidence angles between 0° and 85°.

Retroreflective delineators of the invention are particularly well suited for use on vertical surfaces, particularly those that are observed at high incidence angles such as guard rails, building walls along alleys, Jersey barriers, etc. Vertical is used herein to mean any generally upright surface as distinguished from horizonal surfaces such as road and deck surfaces. An advantage of delineators of the invention is that in addition to exhibiting improved retroreflective brightness at high incidence angles, they also exhibit high retroreflective brightness at lower entrance angles, e.g., within 30° to 40° of normal, which signs are often observed. This makes articles of the invention especially well suited for use on walls and barriers along highways and other applications where a vehicle may approach the structure from a wide range of angles at which effective retroreflective brightness is desired. Delineators of the invention can be used in curved formats, e.g., wrapped around traffic cones and barrels, on curved guardrails, etc., providing excellent retroreflective brightness essentially along the entire visible or line-of-light portion because of the exceptional entrance angularity of the retroreflective marking. As a result, the visibility of the marking and thus delineator under retroreflective conditions is increased, thereby increasing safety.

BRIEF DESCRIPTION OF THE DRAWINGS

The invention will be further explained with reference to the drawings, wherein.

These figures, which are idealized and not to scale, are intended to be merely illustrative and non-limiting.

DETAILED DESCRIPTION OF ILLUSTRATIVE EMBODIMENTS

Figure 1:
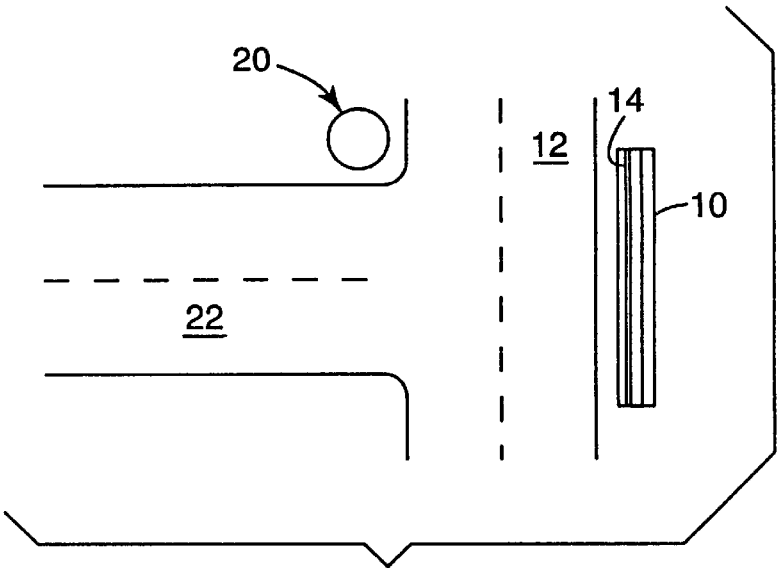
FIG. 1 is a plan view of two illustrative arrangements of vertical traffic delineators in accordance with the invention.

FIG. 1 illustrates two traffic delineators of the invention. Delineator 10 is a Jersey barrier disposed alongside first road 12 with retroreflective marking 14 thereon. Delineator 20 is a round barrel positioned near the intersection of second road 22 with first road 12 and having a retroreflective marking thereon.

Delineators of the invention comprise retroreflective materials that provide high retroreflective brightness at both high entrance angles and at low entrance angles.

Illustrative examples of delineators include guard rails, Jersey barriers, bridge abutments, walls, barrels, and posts. They can also be used on vehicles if desired, e.g., the sides of a truck trailer or railroad box car.

The retroreflective materials may be in any convenient form, e.g., flexible sheeting mounted with adhesive, rigid panels or sheets, etc., depending upon the desired application.

Traffic delineators of the invention have a vertically disposed retroreflective marking thereon, wherein at least a portion of the marking is disposed substantially parallel to a first road.

In addition to being positioned relative to the road and hence traffic as described herein, the marking is retroreflective at both low entrance angles and high entrance angles. Typically the marking is retroreflective at substantially all incidence angles between 0° and 85°, preferably at substantially all incidence angles between 0° and 89°, and more preferably at substantially all incidence angles between 0° and 90°. It is typically preferred that the retroreflective brightness of the marking at an incidence angle of about 88° be at least 20 percent, preferably at least 40 percent, of the retroreflective brightness of the same marking at an incidence angle of about 5° so that the delineator provides more consistent performance at all angles of approach.

Preferably the marking provides a retroreflective brightness of at least 5 candela/lux/meter$^2$, more preferably at least 20 candela/lux/meter$^2$, at most preferably at least 50 candela/lux/meter$^2$, at incidence angles of 88°.

Figure 2:
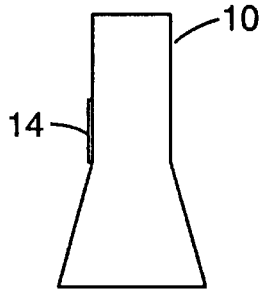
FIG. 2 is a cross sectional view of an illustrative delineator of the invention.

Referring to FIGS. 1 and 2, delineator 10 is a Jersey barrier comprising marking 14 thereon. As shown, major (i.e., having an area of 50 centimeters$^2$ or more) portions of marking 14 are substantially planar. If desired, major portions or even substantially all of marking 14 may be contoured or non-planar in either or both of the vertical and horizontal dimensions. For example, the marking may be on a guard rail that is parallel to a curved road, or the guard rail may have a vertical face that is curved. In another instance discussed below, the delineator may have a round horizontal cross section to which the marking conforms.

In many embodiments, the delineator and marking are configured such that at least some portions of the marking are disposed at a height between about 0.6 and about 2.5 meters (about 2 and about 8 feet) above the surface of the road. When positioned in this manner, the marking will provide improved visibility of the delineator to most approaching vehicles. It will be understood that for some applications markings may be positioned outside this range in accordance with the invention. For example, on roads that are heavily used by trucks and other large vehicles, it may be desirable to position at least portions of the retroreflective markings at heights above 2.5 meters (8 feet).

An important advantage of the present invention is the wide range of entrance angles through which the marking material provides an effective retroreflective response. As a result, the single marking can provide effective retroreflective presence to vehicles approaching from a variety of angles. In some embodiments of the invention, a second road intersects the first road (alongside which the marking is disposed) at an intersection angle of between about 45° and about 90° with the area of intersection being adjacent the delineator. FIG. 1 shows such an embodiment where second road 22 intersects first road 12 substantially perpendicularly along the portion of first road 12 wherein delineator 10 with marking 14 is located.

Delineators of the invention may be made with an retroreflective material that provides the desired wide entrance angularity retroreflective response. So-called exposed-lens and enclosed-lens retroreflective materials can be used. Typically, however, it will be preferred that the retroreflective material be an enclosed-lens retroreflective material because such materials remain retroreflective under wet conditions at which exposed-lens materials no longer function. Enclosed-lens retroreflective sheetings with flat cover films (also sometimes referred to as top films, top sheets, cover sheets, etc.) have been constructed as a means for improving wet retroreflectivity. U.S. Pat. No. 4,505,967 (Bailey) discloses embedded-lens retroreflective sheeting that is effective over a wide range of entrance angles. U.S. Pat. No. 4,025,159 (McGrath) discloses encapsulated-lens retroreflective articles.

In some instances, markings of the invention may be made using retroreflective sheeting, sometimes referred to as a base sheet, that does not itself possess the requisite wide entrance angularity in combination with means to broaden the angularity. For example, means for redirecting incident light to more useful orientations can be used.

Light that would ordinarily be specularly reflected at relatively useless angles upon incidence at an oblique angle to an enclosed-lens retroreflective sheeting is redirected to more favorable angles so as to enter the base sheet such that a portion of the light is retroreflected by the underlying base sheet and refracted or reflected again, depending upon the nature of the means for redirecting light, so as to be directed toward the originating light source. Such combination systems are referred to herein as composite retroreflective articles or systems.

Assignee's copending U.S. application Ser. No. 08/671,435 (Attorney Docket No. 51225U.S.A.7A), which is incorporated herein by reference in its entirety, discloses a composite retroreflective system comprising retroreflective base sheets and an array of light refracting elements. When used as a marking in a vertical delineator as described herein superior performance at a variety of entrance angles is provided.

Assignee's copending U.S. application Ser. No. 08/671,280 (Attorney Docket No. 51225U.S.A.3C), which is incorporated herein by reference in its entirety, discloses a composite retroreflective system comprising retroreflective base sheets and array of spherical lens elements that can be used as the retroreflective marking in vertical delineators of the present invention.

European Patent Application No. 90302123.6, Publn. No. 0 385 746 (Kobayashi et al.), which is incorporated herein by reference in its entirety, describes a composite retroreflective system that that can be used in vertical delineators of the present invention.

U.S. Pat. No. 4,145,112 (Crone), which is incorporated herein by reference in its entirety, discloses composite retroreflective article that is taught to be useful as a pavement marking article. This article can be used as the retroreflective marking in delineators of the invention. The articles disclosed in that patent comprise an underlying base retroreflective layer and a light directing layer comprised of a longitudinally-extending series of short transparent projections which each have front and back (defined relative to the expected origin of light to be retroreflected) upwardly extending edge surfaces. The front edge surfaces are disposed across the expected path of high-incidence angle light, whereby they transmit rather than reflect away a high percentage of incident light from approaching motor vehicles. The back edge surface is disposed to both reflect light transmitted through the front edge surface to a path within a predetermined angular range for retroreflection by the retroreflective elements, and to reflect light retroreflected by the retroreflective elements back through the front edge surface toward its source. A precise configurational relationship of the front and back upwardly extending edge surfaces of each projection must be established and maintained in order to retain adequate retroreflectivity.

U.S. Pat. No. 4,236,788 (Wyckoff) discloses a related type of pavement marker strip wherein the two sides of the transverse prisms are adjusted to provide for downward internal reflection into the base sheet from one side and refraction to the space between successive prisms into the base sheet from the other side. As with the article disclosed in U.S. Pat. No. 4,145,112, maintenance of a precise configurational relationship between the two upward faces of the prisms is critical. This reference does not teach that the material can be used on vertical surfaces to provide effective retroreflection at low incidence angles as well as high incidence angles.

Another way to increase the entrance angularity of a retroreflective marker for use in the present invention is shape the retroreflective material into contoured portions. Applicants' copending U.S. application Ser. No. 08/672,143, (Attorney Docket No. 51416U.S.A.2A), which is incorporated herein in its entirety, discloses contoured retroreflective materials suitable for use in the present invention.

Illustrative examples of enclosed-lens retroreflective sheetings that can be used as base sheets in markings of the invention include encapsulated-lens sheetings and embedded-lens sheetings. Illustrative encapsulated-lens sheetings include microsphere-based retroreflective sheetings that comprise a monolayer of transparent microspheres partially embedded in a binder layer with reflective layers on the rear (i.e., embedded) portions thereof and air interfaces to the front surfaces thereof provided by a cover sheet disposed in front of the microspheres and cube corner type sheetings that comprise a monolayer of cube corner retroreflective elements having an air interface protected by a sealing layer. Illustrative embedded-lens sheetings include microsphere-based retroreflective sheetings that comprise a monolayer of transparent microspheres whose front and rear surfaces are embedded in a transparent matrix and a reflective layer spaced from the rear surfaces of the microspheres by a selected distance. Cube corner type materials wherein the cube corner elements have been covered with a specularly reflective metal layer may be used if desired. U.S. Pat. No. 4,025,159 (McGrath) discloses some microsphere type and cube corner type encapsulated-lens retroreflective sheetings that can be used herein. U.S. Pat. No. 4,505,967 (Bailey) discloses an embedded-lens retroreflective sheeting that is particularly well suited and preferred for use herein. Embedded-lens retroreflective sheetings are available in commercial forms that are quite durable and flexible. In addition, embedded-lens retroreflective sheetings are available in embodiments that provide effective retroreflective performance at higher entrance angles than many encapsulated-lens systems. 3M SCOTCHLITE Brand Reflective License Plate Sheeting No. 3750 is an illustrative example of a commercial retroreflective sheeting that can be used in delineators of the invention.

Preferably all of the component layers of the retroreflective base sheeting adhere together in all types of weather conditions under the stresses encountered by the resultant delineator.

Figure 3:
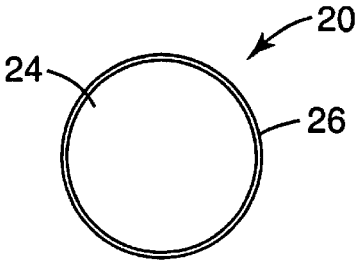
FIG. 3 is a cross sectional view of another illustrative delineator of the invention.

Referring to FIG. 3, delineator 20 comprises barrel 24 with retroreflective marking 26 on the surface thereof. Due to the effective retroreflective brightness of marking 26 at both low entrance angles and high entrance angles, essentially the entire width of the delineator will be retroreflective, making delineator 20 more visible and thereby enhancing safety.

The delineators provided herein are especially useful on the sides of vehicles, e.g., truck trailers or railroad box cars. As they and other vehicles travel, they are observed from a full range of angles. The wide range entrance angularity of delineators of the invention will provide excellent visibility throughout all observation perspectives.

Glossary

The following definitions are used herein when discussing the geometry of retroreflection:

"Reference Axis" is the line normal to the retroreflective article at the point where light is incident thereto.

"Incidence Axis" is the axis defined by the path of incident light from the light source, e.g., the headlight of a motor vehicle, to the point of incidence on the article.

"Entrance Angle" (sometimes referred to as "Incidence Angle" and also as $\beta$) is the angle between the Reference Axis and the Incidence Axis.

"Observation Axis" is the axis defined by the path of retroreflected light from the point of incidence on the article to the observation point, e.g., the eyes of the driver of the motor vehicle.

"Observation Angle" (sometimes referred to as $\alpha$) is the angle between the Entrance Axis and Observation Axis.

"Entrance Plane" is the plane defined by the Reference Axis and the Incidence Axis.

"Observation Plane" is the plane defined by the Observation Axis and the Incidence Axis.

Various modifications and alterations of this invention will become apparent to those skilled in the art without departing from the scope and spirit of this invention.

What is claimed is:

1. A traffic delineator having a vertically disposed marking thereon, wherein at least a portion of said marking is disposed substantially parallel to a first road and is retroreflective at substantially all incidence angles between 0° and 85° and wherein the retroreflective brightness of said marking at an incidence angle of about 88° is at least 20 percent of the retroreflective brightness of said marking at an incidence angle of about 5°.

2. The delineator of claim 1 wherein said marking is retroreflective at substantially all incidence angles between 0° and 89°.

3. The delineator of claim 1 wherein said marking is retroreflective at substantially all incidence angles between 0° and 90°.

4. The delineator of claim 1 wherein the retroreflective brightness of said marking at an incidence angle of about 88° is at least 40 percent of the retroreflective brightness of said marking at an incidence angle of about 5°.

5. The delineator of claim 1 wherein portions of said marking are substantially planar.

6. The delineator of claim 1 wherein portions of said marking are non-planar.

7. The delineator of claim 1 wherein portions of said marking are disposed at a height between about 0.6 and about 2.5 meters (about 2 and about 8 feet) above the surface of the road.

8. The delineator of claim 1 wherein a second road intersects said first road at an intersection angle of between about 45° and about 90°, said area of intersection being adjacent said delineator.

9. The delineator of claim 1 wherein said delineator is selected from the group consisting of a guard rail, a Jersey barrier, bridge abutment, a wall, a barrel, and a post.

10. The delineator of claim 1 wherein said marking comprises an enclosed-lens retroreflective material.

* * * * *